US007516992B2

(12) United States Patent
Peng

(10) Patent No.: US 7,516,992 B2
(45) Date of Patent: Apr. 14, 2009

(54) LATCH STRUCTURE

(75) Inventor: Jung-Chang Peng, Taichung (TW)

(73) Assignee: Door & Window Hardware Co., Taichung (TW)

( * ) Notice: Subject to any disclaimer, the term of this patent is extended or adjusted under 35 U.S.C. 154(b) by 0 days.

(21) Appl. No.: 11/610,516

(22) Filed: Dec. 14, 2006

(65) Prior Publication Data

US 2008/0143122 A1 Jun. 19, 2008

(51) Int. Cl.
*B05D 33/34* (2006.01)

(52) U.S. Cl. ..... 292/326; 292/251.5; 292/341.16; 292/DIG. 15

(58) Field of Classification Search ..... 292/251.5, 292/341.16, 44, 95, 116, 121, 128, 102, 108, 292/213, 219, 304, DIG. 15; 24/303
See application file for complete search history.

(56) References Cited

U.S. PATENT DOCUMENTS 5,016,929 A * 5/1991 Frolov ..... 292/251.5
5,641,187 A * 6/1997 Frolov ..... 292/251.5
6,260,892 B1 * 7/2001 Chang ..... 292/251.5
6,609,738 B1 * 8/2003 Roth et al. ..... 292/251.5
6,857,671 B2 * 2/2005 Fly ..... 292/251.5
6,902,214 B2 * 6/2005 Smith ..... 292/251.5

* cited by examiner

*Primary Examiner*—Patricia Engle
*Assistant Examiner*—Mark Williams
(74) *Attorney, Agent, or Firm*—patenttm.us

(57) ABSTRACT

A latch structure is provided herein. The latch structure comprises a base, a plate, a rotating element, hooks, a magnetic element, springs, locating posts, a latch element, a pushing element, and screws. One side of the magnetic element is rotatable by the pin, and the other side is mounted with the spring and the locating post. When door is closed inwardly, the pushing element pushes the rotating element forwardly to push the magnetic element contacting with the latch element which are attracting due to the magnetic field. The hooks then engage with the connecting portions. When power is off, spring abuts the magnetic element to release the hook from the connecting portion. The benefit is that as long as the attract force of the magnetic field larger than the pressure of the spring, the hooks and the latch element are decided to engage or separate, increasing the load ability of the latch structure. It is therefore large load ability is acquired only required few attract force, decreasing costs.

1 Claim, 4 Drawing Sheets

LATCH STRUCTURE

TECHNICAL FIELD OF THE INVENTION

The present invention generally relates to latch structures, and particularly to latch structures utilizing magnetic field and coil to achieve the object.

DESCRIPTION OF THE PRIOR ART

Conventional latch structure utilizes magnetic field and coil to generate magnetic force, providing loading ability. For example, there is 200 KG magnetic force to support 200 KG loading, and 500 KG magnetic force to support 500 KG loading. As the magnetic force is large, the cost is more, and the residual magnetism is increased so that the expensive material is required. The silicon steel is utilized to solve the residual magnetism. When attract force of loading ability is 200 KG during test, the residual magnetism is about 3~5 KG. The loading ability is larger, the residual magnetism is higher. Therefore, the door or window is not opened immediately as the power is off. The resistance force is gone till a predetermined period.

SUMMARY OF THE INVENTION

The primary purpose of the present invention is to provide a latch structure including a base, a plate, a rotating element, hooks, a magnetic element, springs, locating posts, a latch element, a pushing element, and screws.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
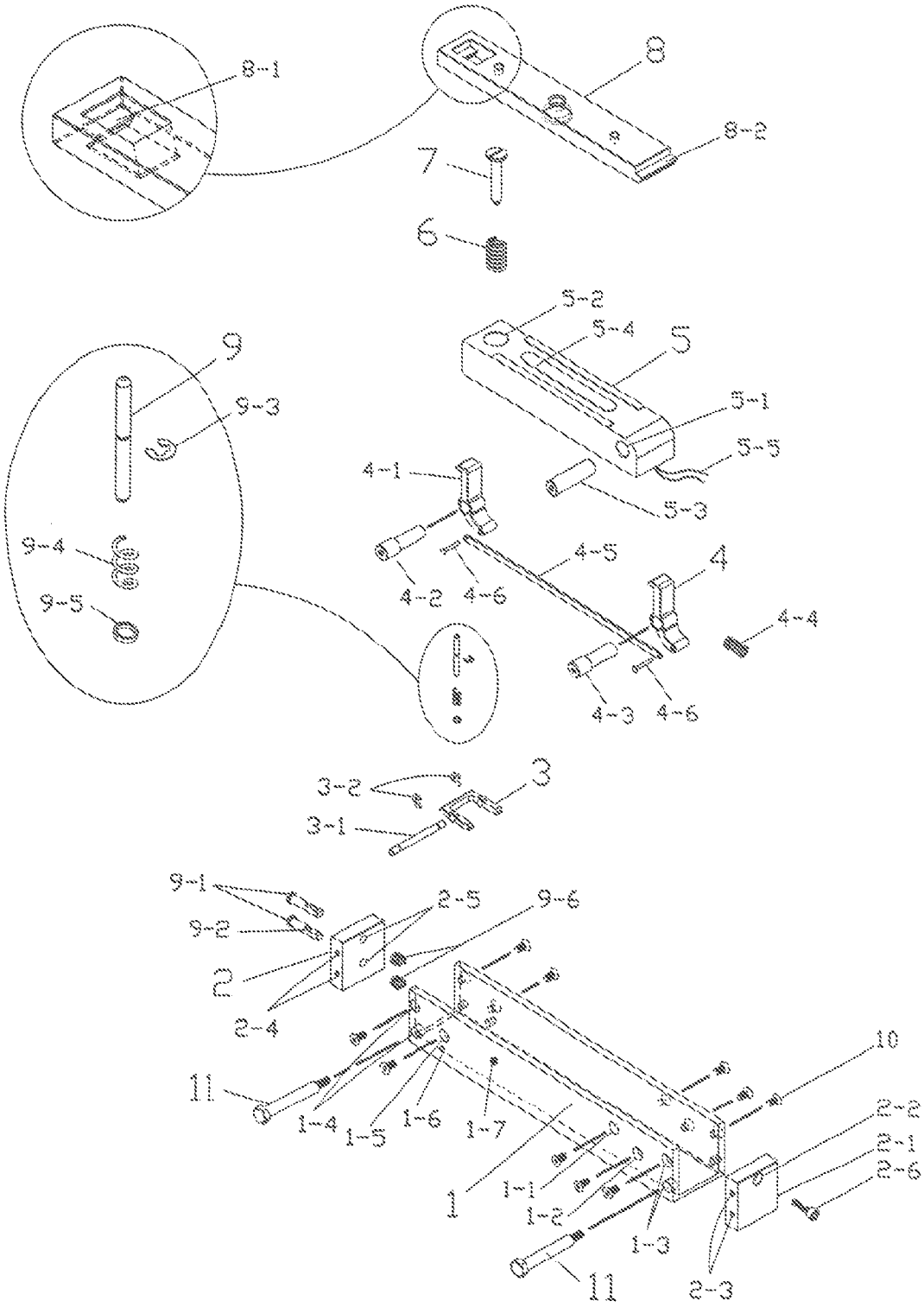
FIG. 1 is a schematic view of an embodiment of a latch structure of the invention.

Referring to FIG. 1, a magnetic element (5) is disposed in a base (1). A pin (5-3) of the magnetic element (5) passes through a hole (1-1) of the base (1) and a hole (5-1) of the magnetic element (5). A post (7) is telescoped with a spring (6) and fixed on a fixing portion (1-7). A left plate (2) is disposed on the left opening of the base (1) and fixed by screws (10) passing through locating holes (1-4) and engaging to the threaded holes (2-4). A rotating element (3) is disposed on the left bottom side of the magnetic element (5) and fixed by pin (3-1) passing through the hole (1-6) and C-ring (3-2). A locating shaft (9-1) of the rotating element (3) passes through a locating hole (2-5) of the rotating element (3) and is telescoped with two springs (9-6). A pushing element (9) downwardly passes through two openings (9-2) before the springs (9-6). The pushing element (9) passes through the openings (9-2) of the first locating shaft (9-1), is telescoped with two springs (9-4) and a cushion (9-5), and passes through the openings (9-2) of the second locating shaft (9-1). A C-ring (9-3) is fixed under the first locating shaft (9-1) so that the springs (9-4) and the cushion (9-5) are disposed between the first and second locating shaft (9-1). The bottom of the pushing element (9) contacts with the upper middle portion of the rotating element (3). A right hook (4) is disposed in the base (1) and fixed by a pin (4-3) passing through the hole (1-2) and the central hole of the right hook (4) and screws (10). A locating post (2-6) passes through a locating hole (2-2) and is telescoped with a spring (4-4). A left hook (4-1) is disposed in the base (1) and fixed by a pin (4-2) passing through the hole (1-5) and the central hole of the left hook (4-1) and screws (10). A coil (5-4) is disposed in the middle of the magnetic element (5). A wire (5-5) is electrically connected to the power switch controller. Screws (11) of the base (1) pass through a locating hole (1-3) of the right plate and a locating hole (1-4) of the left plate to be mounted on a door frame (12).

Figure 2:
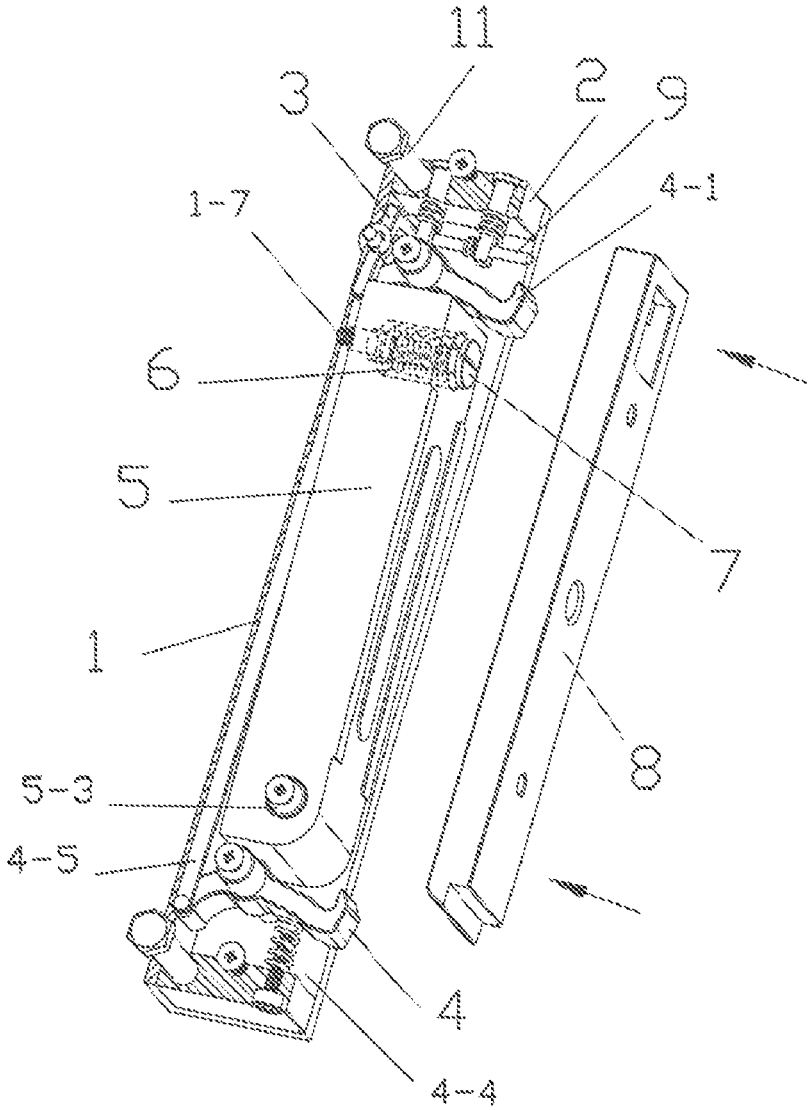
FIG. 2 is a sectional view of an embodiment of a latch structure of the invention.

Referring to FIG. 2, the magnetic element (5) is disposed in the base (1) with the right side rotatably fixed by a pin (5-3) and the left side movably disposed by a locating post (7) telescoped with a spring (6) to a fixing portion (1-7). The rotating element (3) is disposed at the left bottom side of the magnetic element (5). When the door is closed, left bottom side of the latch element (8) pushes the pushing element (9) backward, the rotating element (3) abuts the magnetic element (5) forward to contact the latch element (8), and the spring 4-4 abuts the right hook (4) leftward. The linking element (4-5) connects the right hook (4) and the left hook (4-1).

Figure 3:
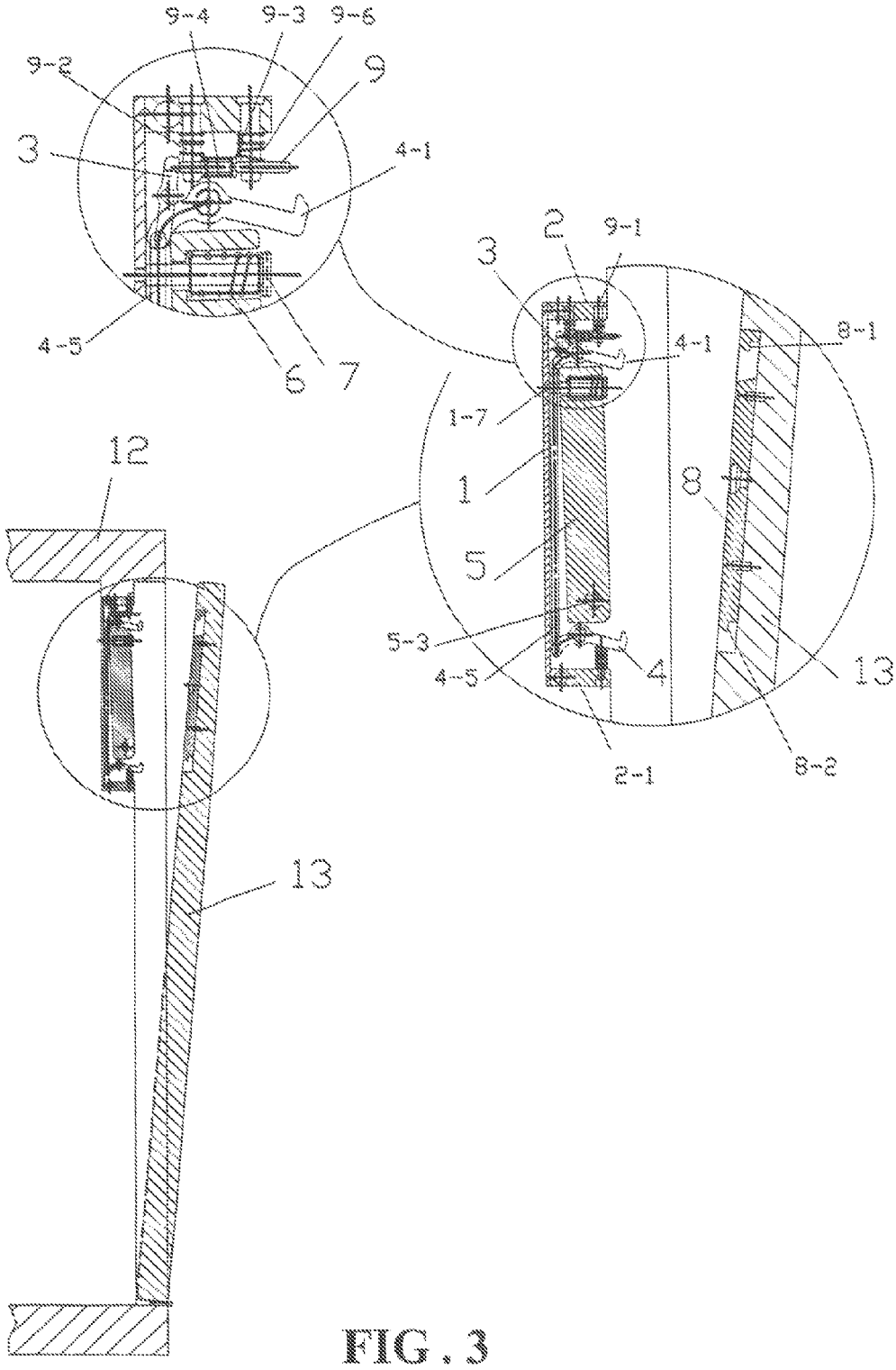
FIG. 3 is a schematic view of an embodiment of a latch structure of the invention when the door is open.

Referring to FIG. 3, when power is off, the magnetic field is gone, and the door is open. The magnetic element (5) is positioned by the pin (5-3) at the right side thereof. The spring (6) abuts the left side of the magnetic element (5) toward the bottom of the base (1) due to the locating post (7). The left bottom side of the magnetic element (5) presses the left hook (4-1) to separates from the left connecting portion (8-1), and the right hook (4) connected with the left hook (4-1) by the linking element (4-5) separates from the right connecting portion (8-1) therewith. When door is closed, the left bottom side of the latch element (8) contacted with the front side of the pushing element (9), as shown in the partially enlarged view. The pushing element (9) is pushed toward the right sideof the openings (9-2) due to the pressure of the spring (9-6).

The springs (9-4) push the pushing element (9) upwardly. When door is closed, the left bottom side of the latch element (8) contacts with the pushing element (9), and the bottom of the pushing element (9) contacts with the rotating element (3).

Figure 4:
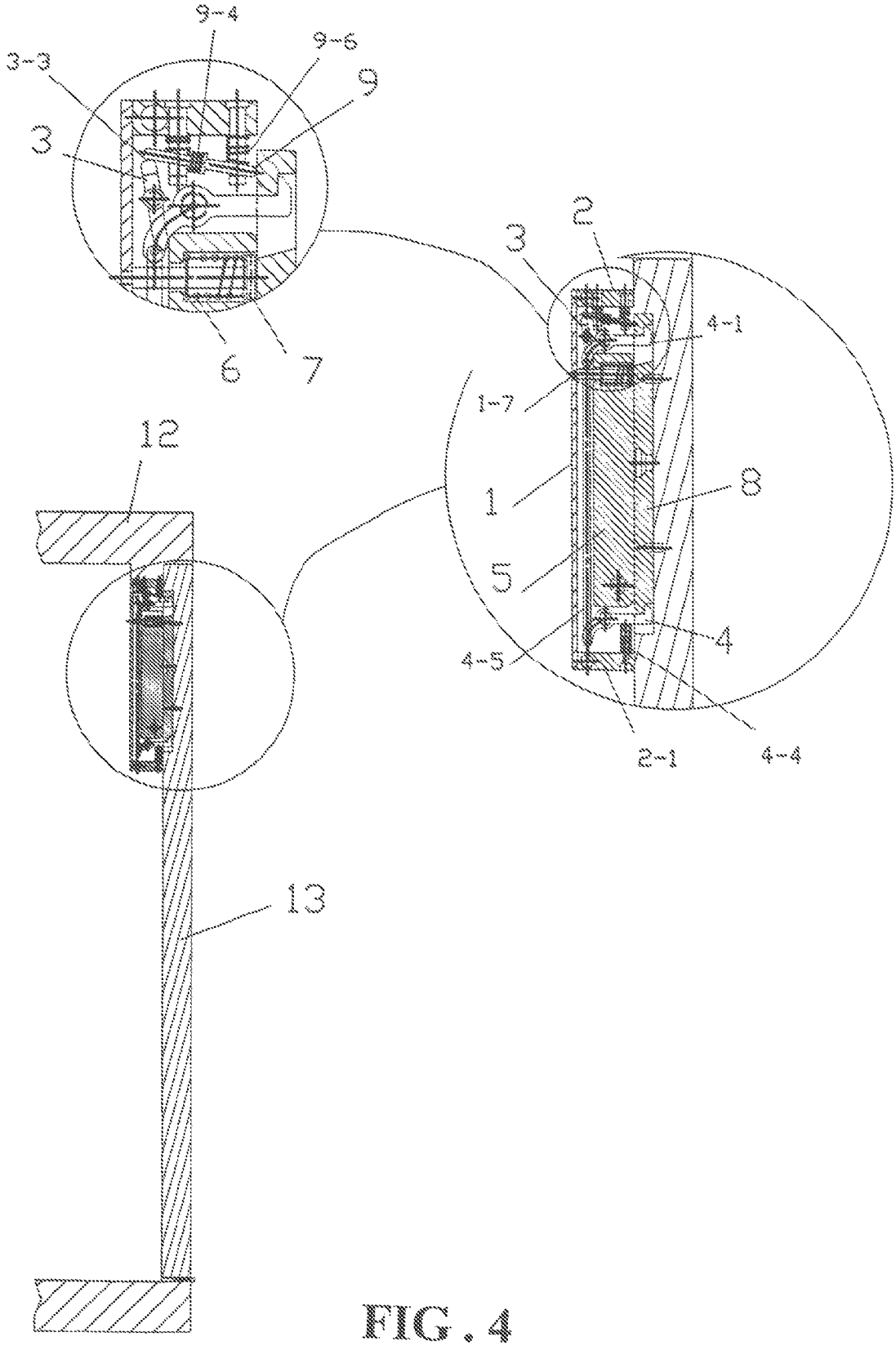
FIG. 4 is a schematic view of an embodiment of a latch structure of the invention when the door is closed.

Referring to FIG. 4, when the door closes inwardly, the left bottom side of the latch element (8) pushes the pushing element (9). The rotating element (3) then abuts the magnetic element (5) to contact with the latch element (8), generating magnetic force and attractive force therebetween. Meanwhile, the spring (4-4) pushes the right hook (4) leftward, and the linking element (4-5) connects the right hook (4) and the left hook (4-1) so that the left hook (4-1) moves therewith. The right hook (4) and the left hook (4-1) respectively engage the right connecting portion (8-2) and the left connecting portion (8-1) at the same time. The pushing bottom of the element (9) contacts with the left side of the rotating element (3) to form a contacting surface.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A latch structure, comprising a first latching structure to be located on a stationary member, said first latching structure comprising:

a base having a fixing portion;

a magnetic element, wherein one side of the magnetic element is rotatably disposed in the base and the other side is movably disposed to the fixing portion of the base by a locating post and a spring;

a right hook disposed at the right side of the magnetic element;

a left hook disposed at the left side of the magnetic element;

a linking element connecting the right hook and the left hook;

a right plate blocked the right side of the base with a locating post and a spring;

a left plate blocked the left side of the base with a locating post and a spring;

a first locating shaft having a first opening and telescoped with a spring;

a second locating shaft having a second opening and telescoped with a spring;

a pushing element passing through the first opening, telescoped with a C-ring and two springs, and passing through the second opening; and a rotating element disposed on the left bottom side of the magnetic element and fixed on the base by a pin; and a latch element to be located on a movable member, wherein the first latching structure engages the latch element in the closed position.

* * * * *